US008388393B1

(12) United States Patent
Eichinger et al.

(10) Patent No.: US 8,388,393 B1
(45) Date of Patent: Mar. 5, 2013

(54) OUTBOARD MOTORS AND EXHAUST SYSTEMS FOR OUTBOARD MOTORS

(75) Inventors: Charles H. Eichinger, Oshkosh, WI (US); Scott G. Ahlswede, Plymouth, WI (US)

(73) Assignee: Brunswick Corporation, Lake Forest, IL (US)

( * ) Notice: Subject to any disclaimer, the term of this patent is extended or adjusted under 35 U.S.C. 154(b) by 211 days.

(21) Appl. No.: 12/939,039

(22) Filed: Nov. 3, 2010

(51) Int. Cl.
*B63H 21/32* (2006.01)

(52) U.S. Cl. ..... 440/89 C; 123/195 P

(58) Field of Classification Search ..... 440/89 A, 440/89 C, 89 D, 89 R, 52; 123/195 P, 196 R, 123/196 W
See application file for complete search history.

(56) References Cited

U.S. PATENT DOCUMENTS 3,431,882 A * 3/1969 Irgens ..... 123/195 P
4,452,194 A * 6/1984 Watanabe ..... 123/195 P
4,583,953 A * 4/1986 Nakase ..... 440/89 C
6,250,982 B1 * 6/2001 Kashima ..... 440/89 R

OTHER PUBLICATIONS

Photograph of a 2004 Yamaha 150 Hp Adapter.
Photograph of a 2005 Suzuki 175 Hp Adapter.
Photographs of a 2005 Suzuki 175 Hp Midsection.
Photograph of a 2005 Suzuki 175 Hp Midsection.
Photograph of a 2006 Yamaha 60 DSH and Oil Sump.
Photograph of a 2005 Yamaha 90 Hp Adapter.
Drawing of a 2005 Yamaha 90 Hp Midsection.

* cited by examiner

*Primary Examiner* — Lars A Olson

(74) *Attorney, Agent, or Firm* — Andrus, Sceales, Starke & Sawall, LLP

(57) ABSTRACT

An outboard motor includes an internal combustion engine, a driveshaft housing, a molded adapter plate connecting the internal combustion engine and the driveshaft housing; and an elongated exhaust conduit conveying hot exhaust gas from the internal combustion engine, the exhaust conduit extending from a first end portion located proximate to the internal combustion engine to a second end portion located proximate to the driveshaft housing. The exhaust conduit and adapter plate are separate components.

18 Claims, 5 Drawing Sheets

OUTBOARD MOTORS AND EXHAUST SYSTEMS FOR OUTBOARD MOTORS

FIELD

The present disclosure relates to outboard motors and exhaust systems for outboard motors.

BACKGROUND AND SUMMARY

Typical four stroke outboard motors have several components that compete for common design space beneath the engine. For example, the exhaust conduit for conveying hot exhaust gas from the engine, the cooling water jacket for cooling exhaust gas in the exhaust conduit, the upper engine mounts, the oil pump, the engine oil sump, and engine oil drain back area all require space just below the internal combustion engine. These components are typically incorporated into a molded engine adapter plate that connects the engine to a housing for the driveshaft. The present inventor has recognized that this competition for design space at the location of the engine adapter plate usually compromises the design of the outboard motor, with added cost, reduced function, reduced performance, or a combination of these factors.

In order to achieve small-sized outboard configurations, typical outboard motors incorporate an engine cylinder block that is rotated so that the engine cylinders are not aligned with a vertical fore-aft central plane extending through the crankshaft. In these configurations, the exhaust conduit for conveying hot exhaust gas from the engine is located apart from the central plane. In fact, even in configurations where the engine cylinder block is not rotated, the exhaust conduit is located apart from the central plane to a certain extent. This off-center exhaust conduit must be routed back into alignment with the central plane at the bottom of the driveshaft housing in order to align with an exit port in the lower unit gear case.

The present inventor has recognized that routing the exhaust conduit back into alignment with the noted central plane undesirably places design constraints on the engine adapter plate, requires a great deal of space, often requires cover plates with screws and gaskets, and can often require sharp, flow-restricting corners in the exhaust conduit. These design constraints also often undesirably require location of the engine mounts at least partially in the exhaust conduit. As the engine adapter plate is utilized to bring the exhaust conduit into alignment with the central plane, the exhaust conduit is often in the way of the engine mounts. Further, placing the exhaust conduit though the center of the oil sump often wastes space and causes the sump to be longer and more expensive to form—in order to obtain a requisite oil volume. The present inventor has found that this is also true in cases where the sump has a "U" shape around the exhaust conduit. Further, U-shaped sumps often undesirably require increased fasteners to maintain a longer sealing flange that accompanies the U-shaped sump.

The present disclosure provides improved outboard motor configurations and exhaust system configurations. In one example, an outboard motor comprises an internal combustion engine, a driveshaft housing and a molded adapter plate connecting the internal combustion engine and the driveshaft housing. An elongated exhaust conduit conveys hot exhaust gas from the internal combustion engine. The exhaust conduit extends from a first end portion located proximate to the internal combustion engine to a second end portion located proximate to the driveshaft housing. The exhaust conduit and adapter plate are separate or segregated components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
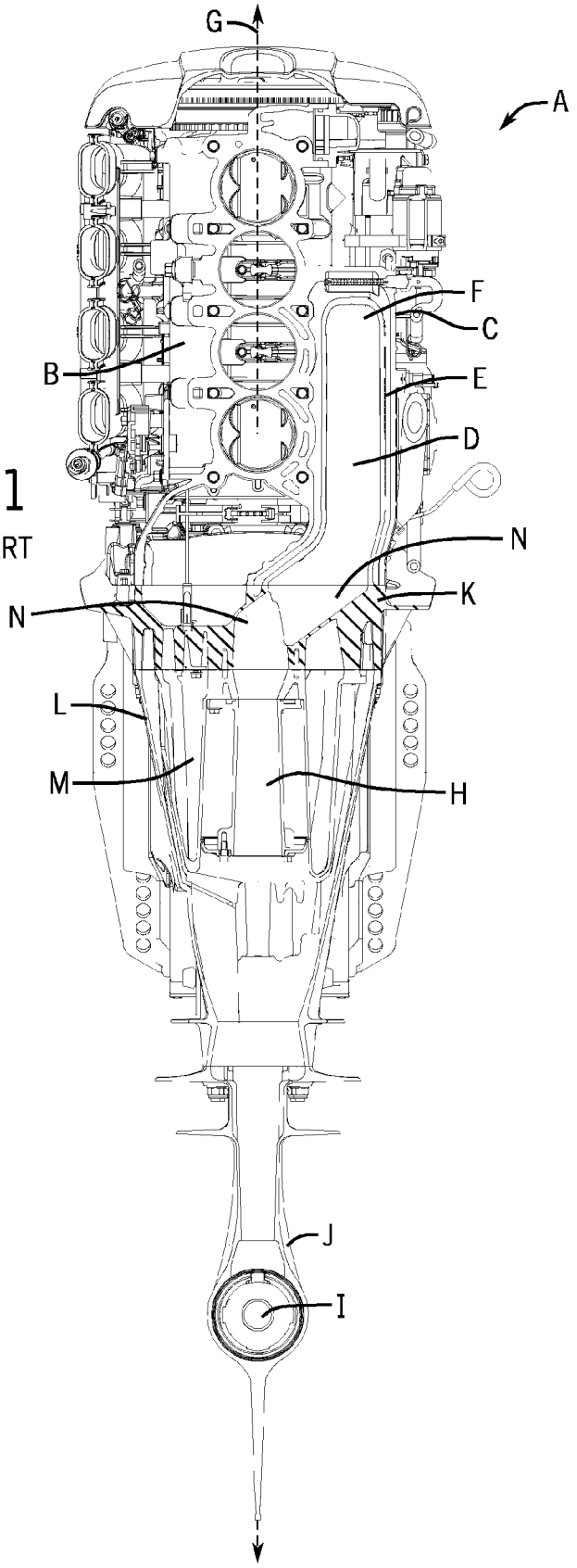
FIG. 1 PRIOR ART
FIG. 1 is a rear sectional view of a prior art outboard motor configuration looking forward.
Figure 2:
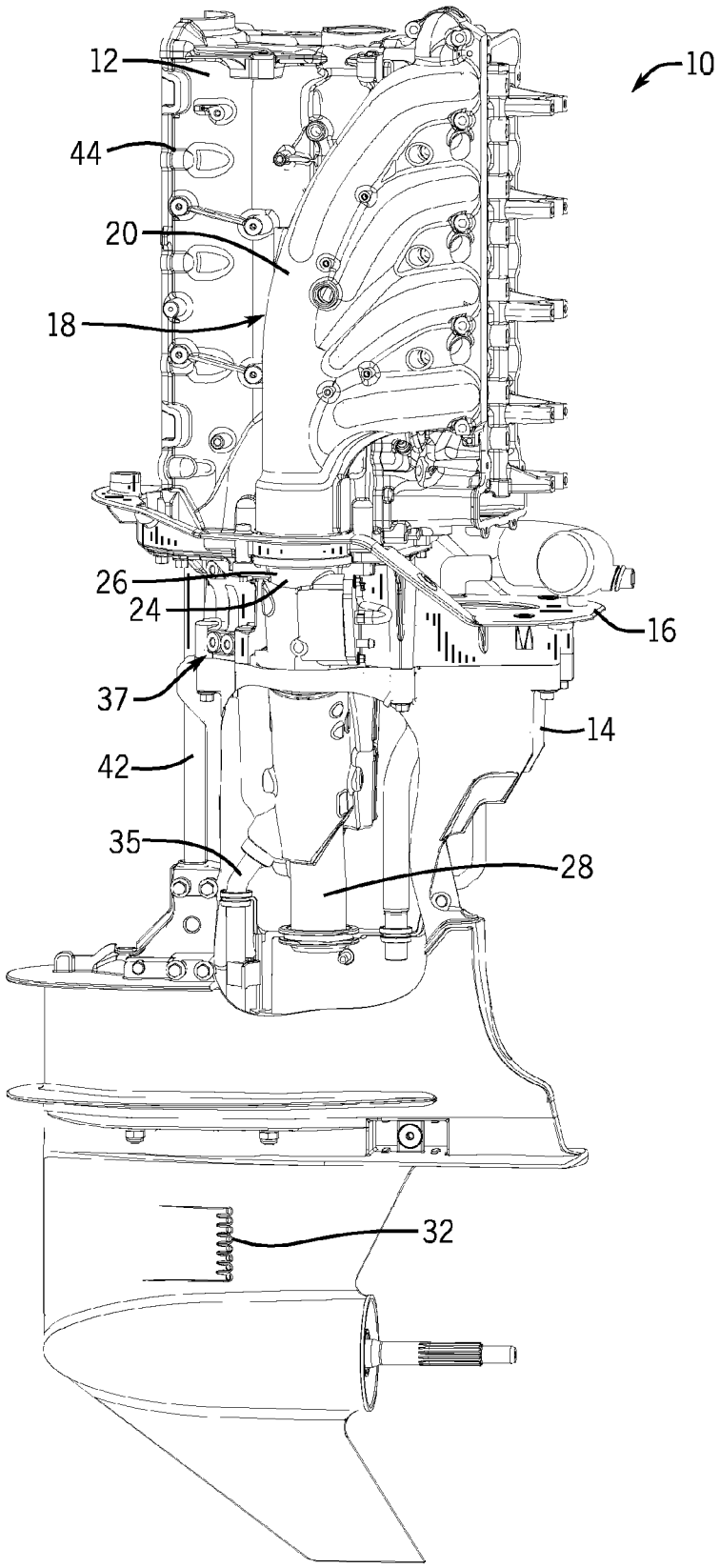
FIG. 2 is a side view of an outboard motor configuration with a portion of the driveshaft removed to show internal components.

FIG. 1 depicts a prior art four-stroke outboard motor A. The outboard motor A has an internal combustion engine B that discharges hot exhaust gas to an exhaust gas system C. The system C includes an exhaust manifold (not shown) that carries the exhaust gas from the engine B to an elongated exhaust conduit D. The exhaust conduit D is surrounded by a cooling water jacket E for cooling the relatively hot walls of the exhaust conduit D. The exhaust conduit D and cooling water jacket E extend from a first end portion F located apart from a vertical fore-aft central plane G extending through the crank shaft (not shown) to a second end portion H located in line with the central plane G. Ultimately, exhaust gas is discharged via an exhaust port I located in the lower unit gear case J.

An adapter plate K shown in cross-hatching supports the internal combustion engine B and connects the internal combustion engine B to the drive shaft housing L. The adapter plate K is a molded component that incorporates a section of the exhaust conduit D, a section of cooling water jacket E, the upper engine mounts (not shown), the engine oil sump M and the related oil drain back area. The above-noted competition for design space amongst the related components of the adapter plate K adds cost, reduces function, and reduces performance of the outboard motor A. For example, routing of the exhaust conduit D from its first end portion F to its second end portion H requires a great deal of space, requires cover plates with screws and gaskets, and requires sharp, flow-restricting corners N in the exhaust conduit D. Further, these design constraints undesirably require optimum location of the noted engine mounts to be compromised to avoid interference with the exhaust conduit D. Because the adapter plate K forms part of the exhaust conduit D to return the exhaust conduit D back into line with the central plane G, the conduit D is undesirably placed in the way of the noted engine mounts. Further, placing the exhaust conduit D through the center of the oil sump M wastes space and causes the sump M to be longer in the vertical direction and more expensive to form. This is also true in cases where the sump M has a "U" shape around the exhaust conduit D.

FIGS. 2-5 depict an outboard motor 10 including an internal combustion engine 12, a drive shaft housing 14 and a molded adapter plate 16 connecting the internal combustion engine 12 to the drive shaft housing 14. The internal combustion engine 12 discharges exhaust gas to an exhaust system 18 that includes, among other things, an exhaust manifold 20 receiving hot exhaust gas from the cylinders 22 of the engine 12, an elongated exhaust conduit 24 extending from a first end portion 26 located proximate to the internal combustion engine 12 and receiving exhaust gas from the exhaust manifold 20 to a second end portion 28 located proximate to the drive shaft housing 14 and discharging exhaust gas to an exhaust outlet port 31. A cooling water jacket 30 surrounds an outer circumference of the exhaust conduit 24, extends with the exhaust conduit 24, and is configured to receive cooling water (not shown) for cooling the walls of exhaust conduit 24, which is heated by the hot exhaust gas being conveyed therethrough. In the example shown, cooling water is drawn into the outboard motor 10 via the cooling water inlet 32 by a pump 34. The cooling water is pumped via an intake pipe 35 to the cooling water jacket 30. After the cooling water flows upwards along the length of the cooling water jacket 30, it is discharged to the internal combustion engine 12 to provide further cooling thereto. Routing of cooling water along the length of the cooling water jacket 30 provides performance advantages that are described in a separate, copending U.S. Patent Application filed by the present inventor.

The internal combustion engine 12 extends in a vertical fore-aft central plane 40 (see FIG. 3) extending through the drive shaft 42 (see FIG. 4), such that the cylinder block 44 of the engine 12 is rotated away from the central plane 40. This places the exhaust manifold 20 and first end portion 26 of the exhaust conduit 24 at a location apart from the central plane 40. In the example shown, the first end portion 26 is located a horizontal distance "d" apart from the central plane 40.

Figure 3:
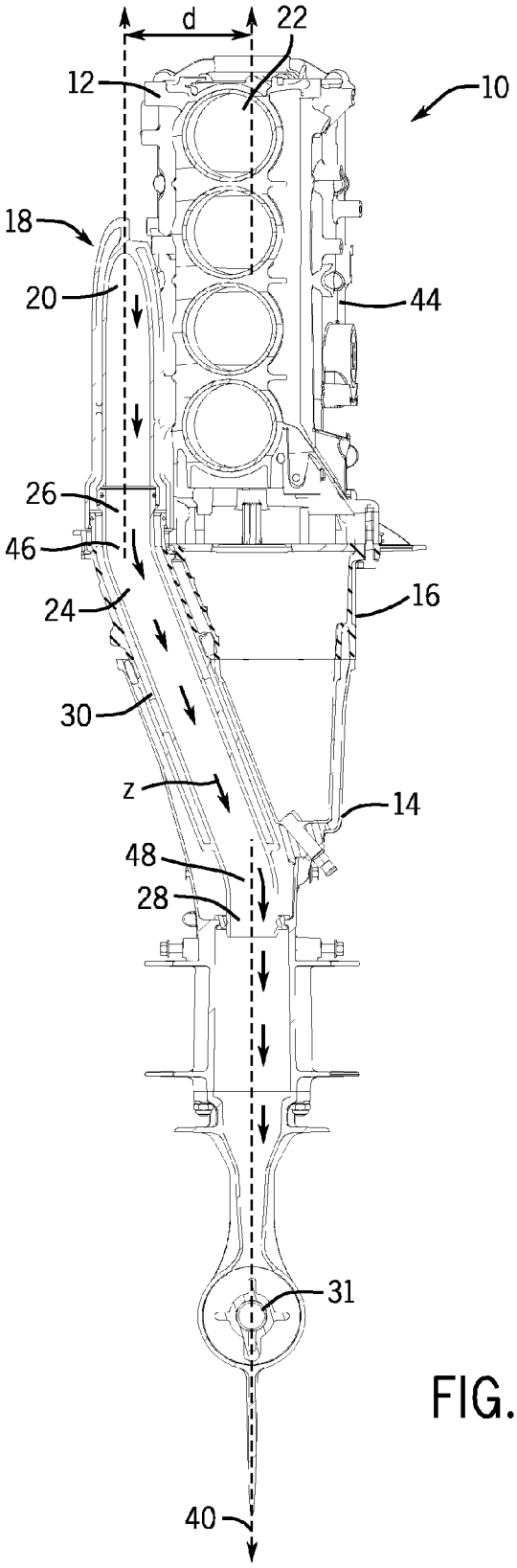
FIG. 3 is a rear sectional view of an outboard motor configuration.
Figure 4:
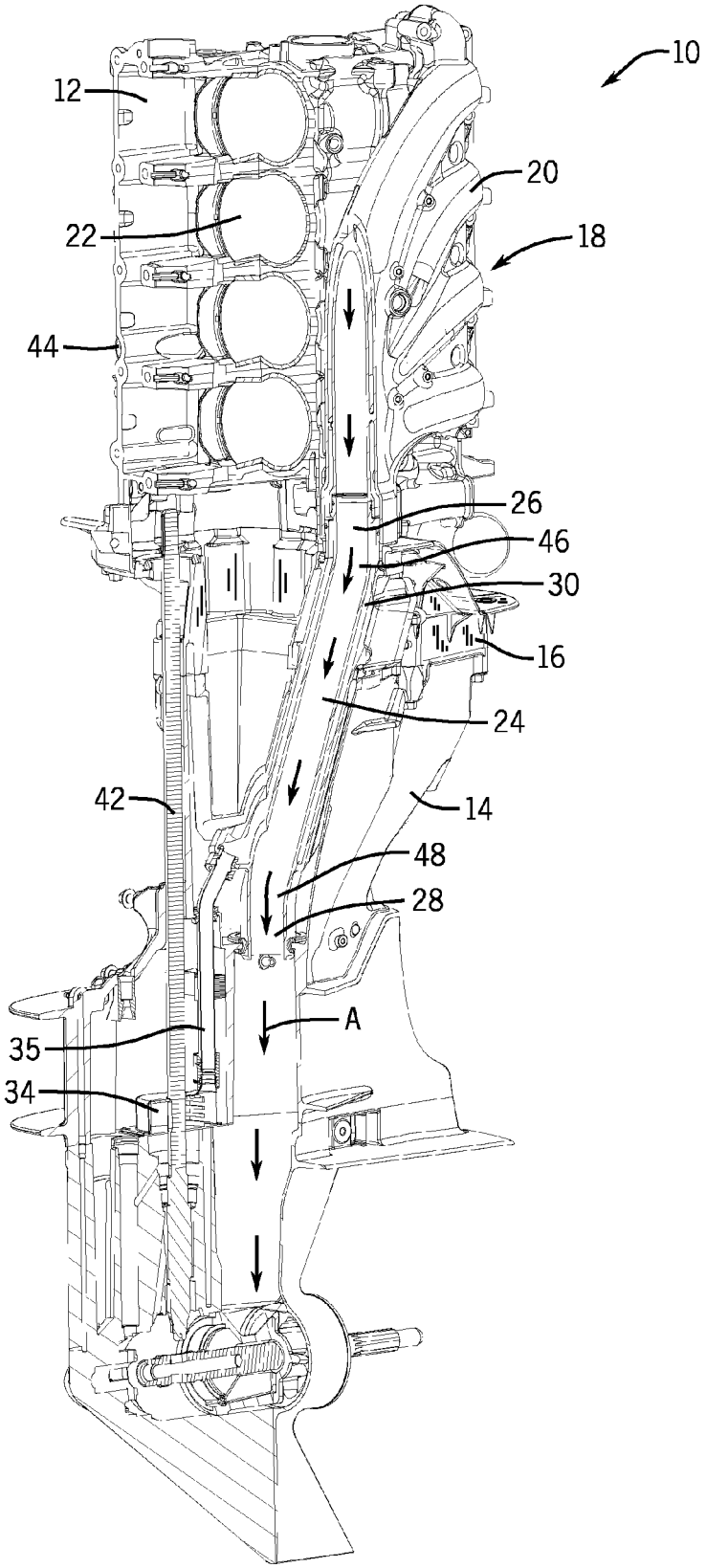
FIG. 4 is a perspective view, partially cut away, of an outboard motor configuration.
Figure 5:
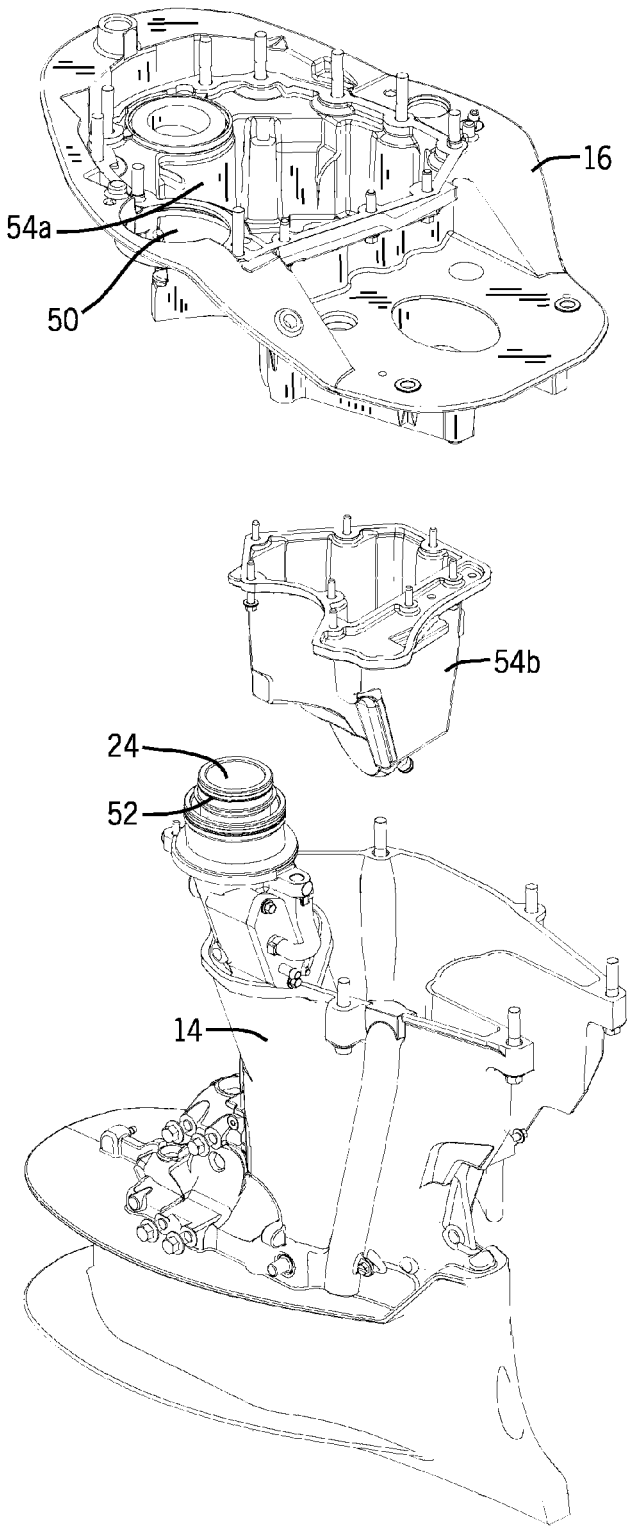
FIG. 5 is an exploded view of an adapter plate, sump and driveshaft housing of an outboard motor configuration.

As shown in FIGS. 3 and 4, the exhaust conduit 24 extends between the noted first end portion 26 and second end portion 28 and includes a series of smooth curved portions including a first smooth curved portion 46 and a second smooth curved portion 48 to route the exhaust conduit 24 the horizontal distance d, back in-line with the central plane 40, proximate to the drive shaft housing 14. The smooth curved portions 46 and 48 do not include sharp corners and therefore advantageously provide minimal flow restriction on exhaust gas conveyed in the exhaust conduit 24 in the direction of arrows z.

The molded adapter plate 16 is also formed separate from or segregated from the exhaust conduit 24. In the example shown, the exhaust conduit 24 passes through the adapter plate 16 via an aperture 50 in the adapter plate 16. A pair of O-ring seals 52 seal the cooling water jacket 30 between the exhaust manifold 20 and the casting containing the exhaust conduit 24 (see FIG. 5), thus saving cost and difficulty of a bolted and gasket joint; however the joint could be bolted if necessary or include an alternate joint design. One O-ring seal seals the water from the exhaust conduit 24 and the other O-ring seal prevents the water from escaping into the atmosphere. This double O-ring design avoids the need for a more expensive and trouble-prone gasket. In addition, an optional seal can be placed between the exhaust conduit 24 and the adapter plate 16 and driveshaft housing 14 to prevent water from escaping the driveshaft housing 14. In this example, the adapter plate 16 is formed by die casting and the exhaust conduit 24 is formed by a sand casting or permanent mold. In alternative examples, the exhaust conduit 24 can be fabricated or lost foam cast. In an alternate example, the exhaust conduit 24 passes around the adapter plate 16 instead of through it. In the example shown, the adapter plate 16 comprises a mounting connecter (located at 37 in FIG. 2) for mounting the outboard motor 10 to a marine vessel (not shown). The adapter plate 16 also forms a portion of the oil sump, as shown at 54*a* and 54*b* in FIG. 5 and related engine oil drainback area.

Separation or segregation of the exhaust conduit 24 and adapter plate 16, as shown in FIGS. 2-5, allows for smooth exhaust passages without wasting space in the adapter plate 16 or requiring expensive casting method for the adapter plate 16. The exhaust conduit 24 passes through or around the adapter plate 16, thus allowing for different fabrication processes and materials to be used for each part. For example, die casting can be used for the relatively simplified adapter plate 16, while more expensive processes can be used for making the water jacketed exhaust conduit 24, such as permanent mold casting, sand casting, lost foam casting, and welded fabrication from multiple components. This example also allows for an extremely off center power head exhaust outlet to be returned to the center of the driveshaft housing. Advantageously, this example also avoids the need to have cooling water jacket passages cast in the adapter plate 16, which can add to the risk of water leaks into the oil sump 54*b* and exhaust system passages. This example also can avoid the common practice of passing the exhaust conduit through the center of the oil sump 54*b* or making the sump in a "U" shape around the exhaust conduit, which is less compact for a given amount of oil volume. This example thus advantageously allows the adapter plate 16 to be designed as a light weight and low cost die casting without compromising oil drain back, sump size and other aspects of the design.

What is claimed is:

1. An outboard motor comprising:

an internal combustion engine, a driveshaft housing and a molded adapter plate connecting the internal combustion engine and the driveshaft housing; and an elongated exhaust conduit conveying hot exhaust gas from the internal combustion engine, the exhaust conduit extending from a first end portion located proximate to the internal combustion engine to a second end portion located proximate to the driveshaft housing; wherein the exhaust conduit and adapter plate are separate components;

wherein the engine extends along a vertical fore-aft central plane, and wherein the elongated exhaust conduit at the first end portion is apart from the central plane and wherein the elongated exhaust conduit at the second end portion is substantially aligned with the central plane.

2. An outboard motor according to claim 1, comprising a cooling water jacket extending with the elongated exhaust conduit for receiving cooling water.

3. An outboard motor according to claim 2, comprising at least one seal sealing between the exhaust conduit and an exhaust manifold for the internal combustion engine.

4. An outboard motor according to claim 1, wherein the elongated exhaust conduit comprises a smooth curved portion between the first end portion and the second end portion.

5. An outboard motor according to claim 1, wherein the first end portion of the elongated exhaust conduit is connected to an exhaust manifold receiving the hot exhaust gas from the internal combustion engine.

6. An outboard motor according to claim 1, wherein the adapter plate forms at least a portion of an oil sump.

7. An outboard motor according to claim 1, wherein the adapter plate is formed by die casting.

8. An outboard motor comprising:

an internal combustion engine, a driveshaft housing and a molded adapter plate connecting the internal combustion engine and the driveshaft housing; and an elongated exhaust conduit conveying hot exhaust gas from the internal combustion engine, the exhaust conduit extending from a first end portion located proximate to the internal combustion engine to a second end portion located proximate to the driveshaft housing; wherein the exhaust conduit and adapter plate are separate components;

wherein the molded adapter plate comprises a mounting connector for mounting the outboard motor arrangement to a marine vessel.

9. An outboard motor comprising:

an internal combustion engine, a driveshaft housing and a molded adapter plate connecting the internal combustion engine and the driveshaft housing; and an elongated exhaust conduit conveying hot exhaust gas from the internal combustion engine, the exhaust conduit extending from a first end portion located proximate to the internal combustion engine to a second end portion located proximate to the driveshaft housing; wherein the exhaust conduit and adapter plate are separate components;

wherein the elongated exhaust conduit passes through the adapter plate.

10. An outboard motor comprising:

an internal combustion engine, a driveshaft housing and a molded adapter plate connecting the internal combustion engine and the driveshaft housing; and an elongated exhaust conduit conveying hot exhaust gas from the internal combustion engine, the exhaust conduit extending from a first end portion located proximate to the internal combustion engine to a second end portion located proximate to the driveshaft housing; wherein the exhaust conduit and adapter plate are separate components;

wherein the elongated exhaust conduit passes around the adapter plate.

11. In an outboard motor having an internal combustion engine, a drive shaft housing and a molded adapter plate connecting the internal combustion engine and driveshaft housing, an exhaust system comprising an elongated exhaust conduit conveying hot exhaust gas from the internal combustion engine and extending from a first end portion located proximate to the internal combustion engine to a second end portion located proximate to the driveshaft housing, wherein the exhaust conduit is segregated from and extends past the adapter plate;

wherein the exhaust conduit comprises a smooth curved transition portion located between the first and second end portions.

12. A system according to claim 11, wherein the outboard motor extends along a fore-aft central plane, and wherein the elongated exhaust conduit at the first end portion is apart from the central plane and wherein the elongated exhaust conduit at the second end portion is substantially aligned with the central plane.

13. A system according to claim 11, wherein the exhaust conduit and adapter plate are formed by different fabrication processes.

14. A system according to claim 11, comprising a cooling water jacket extending with the elongated exhaust conduit for receiving cooling water.

15. A system according to claim 14, wherein the cooling water jacket surrounds an outer circumference of the elongated exhaust conduit.

16. A system according to claim 14 comprising at least one seal sealing between the cooling water jacket and the adapter plate.

17. In an outboard motor having an internal combustion engine, a drive shaft housing and a molded adapter plate connecting the internal combustion engine and driveshaft housing, an exhaust system comprising an elongated exhaust conduit conveying hot exhaust gas from the internal combustion engine and extending from a first end portion located proximate to the internal combustion engine to a second end portion located proximate to the driveshaft housing, wherein the exhaust conduit is segregated from and extends past the adapter plate;

wherein the elongated exhaust conduit passes through the adapter plate.

18. In an outboard motor having an internal combustion engine, a drive shaft housing and a molded adapter plate connecting the internal combustion engine and driveshaft housing, an exhaust system comprising an elongated exhaust conduit conveying hot exhaust gas from the internal combustion engine and extending from a first end portion located proximate to the internal combustion engine to a second end portion located proximate to the driveshaft housing, wherein the exhaust conduit is segregated from and extends past the adapter plate;

wherein the elongated exhaust conduit passes around the adapter plate.

* * * * *